US005314759A

United States Patent [19]

Harkonen et al.

[11] Patent Number: 5,314,759

[45] Date of Patent: May 24, 1994

[54] PHOSPHOR LAYER OF AN ELECTROLUMINESCENT COMPONENT

[75] Inventors: Gitte Harkonen; Kari Harkonen; Runar Tornquist, all of Espoo, Finland

[73] Assignee: Planar International Oy, Espoo, Finland

[21] Appl. No.: 727,662

[22] Filed: Jul. 9, 1991

[30] Foreign Application Priority Data

Jul. 18, 1990 [FI] Finland ..... 903633

[51] Int. Cl.[5] ..... H05B 33/14

[52] U.S. Cl. ..... 428/690; 428/917; 428/216; 428/333; 428/336; 313/503; 313/502; 313/506; 313/507; 313/508

[58] Field of Search ..... 428/690, 691, 917, 216, 428/333, 336; 313/502, 503, 506, 507, 508

[56] References Cited

U.S. PATENT DOCUMENTS 4,137,481 1/1979 Hilsum et al. ..... 313/506

OTHER PUBLICATIONS

Suyama et al. Appl. Phys. Lett. 41(5) Sep. 1, 1982 pp. 462–465.

Morton et al., SID 81 Digest, vol. XII pp. 30–31.

*Primary Examiner*—Ellis P. Robinson
*Assistant Examiner*—Charles R. Nold
*Attorney, Agent, or Firm*—Jones, Day, Reavis & Pogue

[57] ABSTRACT

The present invention relates to a multilayer phosphor layer system for an electroluminescent display. The phosphor layer according to the invention is comprised of several superimposed host matrix material layers (7) and interposed activator-containing doping layers (9, 10). The activator-containing doping layers (9, 10) are extremely thin, whereby disturbance to crystal growth of the host matrix material at the doping layer (9, 10) is avoided. The activator-containing doping layer (9, 10) can be comprised of an actual activator layer (10) and a matching layer (9) adapted between said host matrix material layer (7) and said actual activator layer (10), whereby said matching layer (9) improves the matching between said host matrix material layer (7) and said actual activator layer (10). By virtue of the layered structure, it is possible to use such host matrix/activator material pairs that otherwise would be useless due to their poor efficiency or weak light emission.

17 Claims, 4 Drawing Sheets

PHOSPHOR LAYER OF AN ELECTROLUMINESCENT COMPONENT

The present invention relates to a phosphor layer in accordance with the preamble of claim 1 in an electroluminescent component.

Phosphor materials used in electroluminescent displays are based on light emission generated by an activator dispersed in a host matrix material at a wavelength within the visible band (approx. 380 . . . 700 nm). The properties of the host matrix material must be suitable for accelerating electrons to an energy level necessary for visible light generation, that is, above 2 eV. The crystallographic environment surrounding the activator atoms generally affects the light emission efficiency, wavelength spectrum and stability. Different combinations of host matrix and activator materials with their emission spectra are known in the art. For instance, the following colour emissions are achievable by use of these material pairs: CaS:Eu emits red, ZnS:Mn yellow-orange, ZnS:Tb green, SrS:Ce blue-green, ZnS:Tm blue and SrS:Pr white.

A fundamental condition for doping the host matrix material with an activator so as to form a homogeneous phase is that the activator atom or an entire emitting center fits into the crystal lattice. This compatibility is affected by, i.a., size difference, and possibly valency difference, between the host matrix material and the activator atoms. Doping of zinc sulfide with manganese in commercially produced electroluminescent displays is an example of good fit of activator atoms into the host matrix material. The compatibility requirement of the activator with the host matrix material limits, however, the number of available mutually matching host matrix-/activator materials and generally leads to a low optimum concentration of activator in the host matrix material. For example, doping of a zinc sulfide matrix with rare earths has been difficult due their dimensional and chemical incompatibility with the crystal lattice of the host matrix material.

Changes in the crystallinity, orientation, crystal lattice defects and electrical characteristics of the host matrix material caused by a homogeneously doped activator can be deleterious to electroluminescence due to deteriorated efficiency and stability. Moreover, the crystal lattice of the host matrix material can be an unfavourable environment for the efficiency of the light emission from the activator. The stability of light emission often remains poor due to the thermodynamical instability of the host matrix/activator material system. The emission efficiency of the host matrix/activator material system is improved by using different coactivators (e.g., SrS:Ce,K,Cl) and/or more complex emission centers (e.g., ZnS:Tb,O,F), which complicates, however, the processing of the phosphor layer.

Phosphor layer structures are known in the art in which the host matrix material and a relatively incompatible activator material are separated into individual layers (ref. to Morton, D. C. and Williams, F., Multilayer thin-film electroluminescent display, SID 1981 Digest, Vol. 12/1, p. 30 . . . 31). In practice this leads to multilayer structures in which said layers are alternately deposited. The activator-containing doping layer has a minimum thickness of 10 . . . 20 nm. An example of such a structure is a phosphor system comprised of alternately deposited layers of thick zinc sulfide and $Y_2O_3$:Eu, giving red emission (ref. to Suyama, T., Okamoto, K. and Hamakawa, Y., New type of thin-film electroluminescent device having a multilayer structure, Appl. Phys. Lett. 41 (1982), p. 462 . . . 464).

Deposition of a separate activator layer interrupts the crystal lattice of the host matrix material and causes problems in maintaining crystallinity, crystal size and orientation of the matrix material. Moreover, the separate activator layers have poor crystallinity and may even be amorphous, which is unfavourable to electron transfer and efficiency of light emission. Electrons lose their energy rapidly in the thick activator layer, hence yielding low efficiency, and moreover, light emission is possible only from a shallow layer at the interface of the host matrix layer and the activator-containing doping layer.

Problems in doping with an activator and the poor crystallinity have limited the efficiency of phosphor layers and the total brightness of light emission.

It is an object of the present invention to achieve a high-efficiency phosphor layer, capable of matching several different host matrix/activator material pairs.

The invention is based on doping the phosphor layer with an activator by depositing activator-containing doping layers in between the host matrix material layers, possibly separated by matching layers, said activator-containing doping layers being so atomic-thin that no essential disturbance is caused to the crystalline structure and orientation of the host matrix material.

More specifically, the phosphor layer according to the invention is characterized by what is stated in the characterizing part of claim 1.

The invention provides outstanding benefits.

The present invention offers a method of separately optimizing both the properties of the host matrix material, which is important to the acceleration of electrons, and the atomic environment of the activator material, which is important to the light emission, in a manner that improves the total efficiency of the phosphor system. By virtue of the present invention, problems associated with conventional doping of a host matrix material with an activator are avoided and novel pairs of host matrix/activator materials can be matched into phosphor layer systems of high efficiency. The present invention facilitates the use of high relative concentrations of the activator.

The degree of crystallinity, crystal size and orientation of the host matrix material layers, and simultaneously, those of the entire phosphor layer system produced by way of the method according to the present invention are superior to the properties obtained either from a homogeneously doped phosphor layer or multilayer phosphor systems comprised of separate, thick layers of the host matrix and activator materials. A further improvement worth mentioning is that the phosphor system structure produced according to the present invention permits a desired degree of crystalline order and local crystal structure at the atomic level to be achieved at a lower process temperature, even without a separate heat treatment, than is possible in conjunction with conventional structures. By way of a proper arrangement of the matching layers and the activator-containing doping layers, it is possible to compensate for crystal defects occurring in the deposition of host matrix layers and to prevent their propagation through the crystal lattice.

The invention is next examined in detail with the help of the attached drawings.

BRIEFING DESCRIPTION OF THE DRAWINGS

Figure 1:
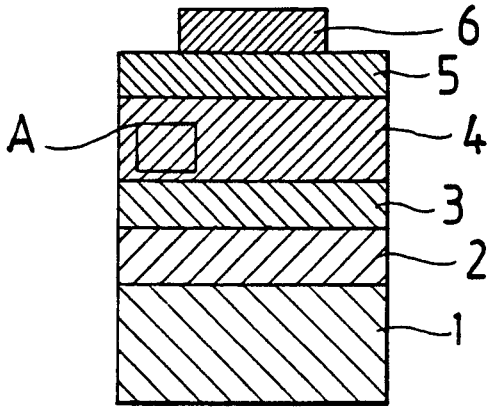
FIG. 1 shows the structure of an electroluminescent display component according to the invention.

The functional principles of the thin-film electroluminescent display component illustrated in FIG. 1, as well as the required layers of the thin-film structure, are well known in the art. The structure comprises a transparent substrate 1 of, e.g., glass, and a thin-film type bottom electrode 2 produced onto said substrate. The bottom electrode 2 is of a transparent material carrying atop it the actual luminescent thin-film structure, which according to the diagram may conventionally incorporate several thin-film-type individual layers named as a lower insulation layer 3, a phosphor layer 4 and an upper insulation layer 5. Atop the luminescent structure is adapted a thin-film-type (generally metallic) tip electrode 6. The bottom electrode 2 and the top electrode 6 may, e.g., form the column and row electrodes of the display matrix.

Figure 2:
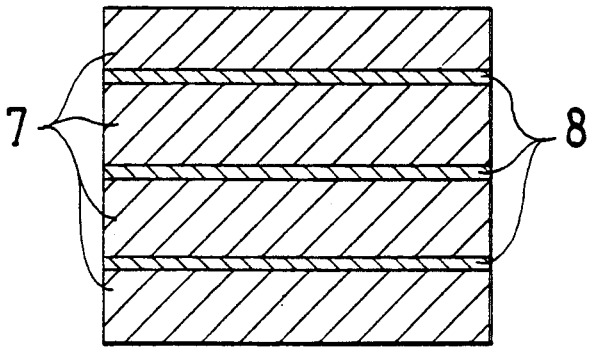
FIG. 2 is a detailed diagram of section of the phosphor layer (section A in FIG. 1).

A part of the phosphor layer 4 of FIG. 1 (that is, the delineated area A in the diagram) is illustrated in greater detail in FIG. 2. The phosphor layer 4 is comprised of layers of different compositions, namely host matrix material layers 7 serving for acceleration of electrons and activator-containing doping layers 8 capable of producing light emission. The activator-containing doping layers 8 are very thin. Their number in the phosphor layer 4 according to the invention is not limited nor need they be identical in composition; rather, to attain various colours, a single phosphor layer 4 can be produced so as to incorporate different kinds of activator-containing doping layers 8, and conversely, a single activator-containing doping layer 8 can be produced so as to contain several different types of activators.

Figure 3:
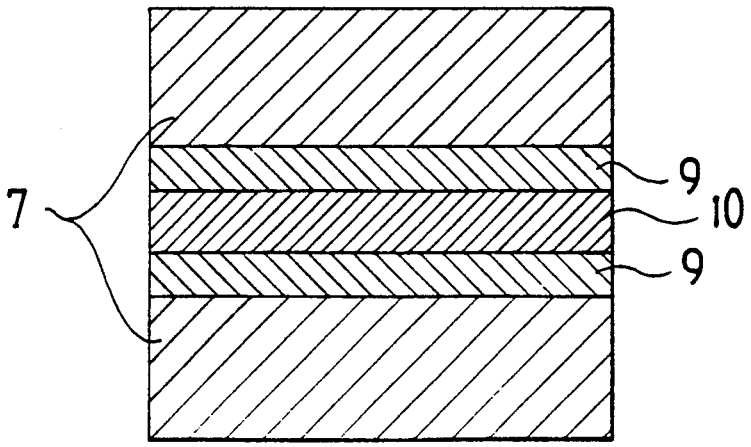
FIG. 3 is a detailed diagram illustrating the doping of the phosphor layer by means of depositing a planar, thin layer of activator material.

FIG. 3 shows an embodiment of the activator-containing doping layer 8 according to the invention comprising matching layers 9 and actual activator layers 10. Shown in FIG. 3 is a situation in which one actual activator layer 10 is adapted between two matching layers 9. The following text will elucidate in greater detail the typical dimensions, functions, material choices and fabrication of the different film-type layers. It must be noted that the proportional scaling in FIGS. 1, 2 and 3 need not represent real dimensions.

According to the basic idea of the invention, crystal growth and orientation in the host matrix material layer 4 are retained in spite of the activator doping. This is possible by virtue of the atomic-thin structure of the matching layers 9 and the actual activator layers 10. Due to their extremely shallow thickness, they match epitaxially on their underlying layer, that is, the crystal structure of the host matrix material layer 7 acting as the substrate, whereby the crystal lattice forces caused by differences in the crystal lattice constants and thermal expansion coefficients are converted into stresses at the layer interfaces that are not relaxed into crystal defects in detrimental quantities.

Typical thicknesses of the film-type layers can be, e.g., less than 100 nm for the host matrix material layers 7; less than 5 nm, preferably less than 1 nm for the matching layers 9; and less than 5 nm, preferably 0.5 . . . 1 nm for the actual activator layers 10. The activator layer comprised of the matching layer and the actual activator layer may have a total thickness of 10 nm.

The purpose of the host matrix material layer 7 is to accelerate electrons to an energy level (>2 eV) sufficient for visible light emission. Therefore, its crystal structure and orientation take a predominant role in the phosphor layer. The thickness of the host matrix material layer 7 can be optimized for practical realizations of display components. Its minimum thickness is determined by the requirements related to electron acceleration and allowable strain fields in the crystal lattice. The host matrix material layer 7 must be sufficiently thick to absorb strains caused in its crystal structure by, e.g., the activator-containing doping layers 8. The upper limit for the thickness of the host matrix material layer (7) is obtained by maximizing the total brightness of light emission available from the phosphor layer 4 (which generally means a maximum number of high-efficiency activator-containing doping layers 8 in the phosphor layer 4). The host matrix material layer 7 can be desiredly thick, yet in practice it is advantageous to set its maximum thickness according to the maximum value of total brightness form the layered structure. The thickness of the phosphor layer 4 is determined by the requirements set for the display component and its performance.

Examples of materials suitable for use as the host matrix material are II–VI compounds (e.g., ZnS, CdS and ZnSe) as well as alkali earth metal chalcogenides (e.g., MgS, CaO, CaS, SrS and BaS). The host matrix material can also be fabricated as a mixed compound of the above materials such as $ZnS_{1-x}Se_x$ or $Ca_{1-x}Sr_xS$. The host matrix material can be doped with an activator material that does not excessively reduce the electrical characteristics of the host matrix material or its crystallinity. Such activators are for instance isoelectronic activators such as $Mn^{2+}$ in zinc sulfide (ZnS:Mn) or $Eu^{2+}$ in calcium sulfide (CaS:Eu). Also other kinds of activators employed for doping in low concentrations in conjunction with coactivators are feasible (e.g., SrS:Ce,K).

The purpose of the matching layer 9 is to match the different crystal structures of the different layer materials. The composition of the matching layer is not necessarily homogeneous, but rather, it can undergo a change through the layer from its one interface to the other in order to match the crystal structures of the host matrix and activator materials with each other. Furthermore, these layers serve to equalize stresses caused by differences in the crystal lattice parameters and thermal expansion characteristics. The matching layer can also act as a chemical buffer layer that prevents chemical reactions and diffusion between the actual activator layer 10 and the host matrix material layer 7.

The matching layer according to the invention provides significant advantages in the stability of light emission. Due to the function and character of the matching layer 9, its thickness is often maximally limited to only a few atomic layers. Suitable matching layer materials are those which can occur in several different crystal structures and in which vacancies, interstitial atoms and mixed valencies can exist as well as substitution at lattice sites. Said materials include different oxides such as $Al_2O_3$, $TiO_2$ and $SiO_2$ and, for instance, materials with spinel or perovskite structure ($ZnAl_2O_4$, $ZnAl_2S_4$, $LaAlO_3$ and $SrTiO_3$). The matching layer can also contain a metal sulfide, e.g. $Al_2S_3$ or CaS.

The matching layer 9 can also be fabricated as a partial layer of the host matrix material layer 7 obtained by modification. Examples of solid solutions obtained by substitution that can act as the matching layer 9 are such that are formed from those atomic layers of zinc sulfide that provide the matching with the activator layer, whereby zinc or sulfur is entirely or partially substituted by calcium, cadmium, oxygen or selenium so that the composition of the matching layer is $Zn_{1-x}Ca_xS$, $Zn_{1-x}Cd_xS$ or $ZnS_{1-x}Se_x$, for instance.

The activator-containing doping layer 8 incorporates an activator layer, which is doped in a planar fashion in accordance with the invention. Examples of employed activators are manganese (Mn) and rare earths such as cerium (Ce), samarium (Sm), europium (Eu), praseodymium (Pr), terbium (Tb) and thulium (Tm). The basic crystal lattice of the activator-containing doping layer 8 is provided by a secondary matrix material capable of yielding high efficiency and good stability of emission, whereby said secondary matrix material can even be dielectric. Furthermore, no requirements are set in regard to its solubility in solid phase, that is, its direct chemical and crystallographic compatibility with the actual host matrix material layer 7. Such suitable materials are, e.g., II–VI compounds like ZnO, ZnS or ZnSe and alkali earth metal chalcogenides like MgS, CaS, BaS or SrS. Also the oxides, oxysulfides or sulfides of rare earths are possible, such as e.g. $Gd_2O_3$, $Y_2O_2S$ or $La_2S_3$ as well aluminates and gallates $(M,Ln)AlO_x$ and $(M,Ln)GaO_x$ in which M=Zn, Ca, Sr or Ba and Ln=Y, La, Gd or Ce. The activator layer can be mainly composed of a halide $MX_2$ or $LnX_3$ or oxyhalide LnOX in which M=Ca, Sr, Ba or Zn and Ln=Y, La, Ce or Gd and X=F, Cl or Br.

Due to its shallow thickness of only a few atom layers, the activator-containing doping layer 8 grows epitaxially onto its substrate. As a result of the planar doping concept according to the invention, the local concentration of the activator can be vary high in comparison with the apparent activator concentration averaged over the entire volume of the phosphor layer 4. The activator and host matrix materials are known in the art, but the value of the invention is appreciated in the possibility of using novel material combinations and use of lamp phosphor materials as the high-efficiency phosphor layers 4 in thin-film electoluminescent display components.

The following examples are discussed to elucidate the typical behaviour and use of atomic-thin planar layers according to the invention in the phosphor layers of an electroluminescent display component.

EXAMPLE 1

Effect of thin $Al_2O_3$:Sm layers on the crystallinity and orientation in a polycrystalline zinc sulfide thin-film layer.

Figure 4:
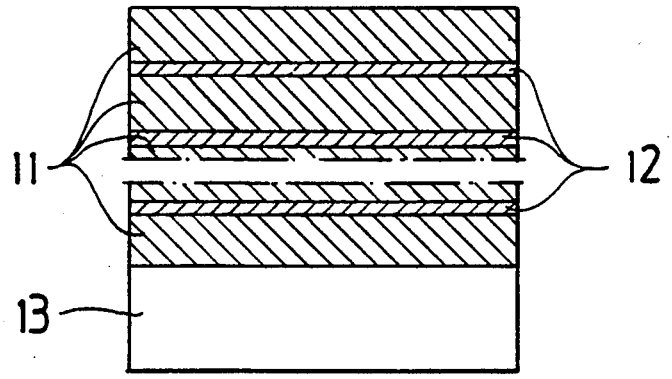
FIG. 4 shows a layered structure deposited onto a substrate by alternately grown layers of host matrix material and intermediate layers.

First, layered thin-film structures shown in FIG. 4 are fabricated using the Atomic Layer Epitaxy (U.S. Pat. No. 4,058,430) deposition method of thin films. Accordingly, the basic structure of obtained samples is Nx(layer 11)+(layer 12))+(layer 11), where N is an integer multiplier, layer 11 is zinc sulfide and layer 12 is aluminium oxide doped with samarium. Glass is used as the substrate 13, the substrate is held at 500° C. during the process, and the inert atmosphere pressure in the process chamber is 1 mbar. The zinc sulfide layers are deposited using zinc chloride and hydrogen sulfide as initial reactants, whereby the film growth rate per a single ALE cycle is approx. 1.25 Å. The $Al_2O_3$:Sm intermediate layers are grown using aluminium chloride, $Sm(thd)_3$ chelate and water as reactants, whereby a single ALE cycle is comprised of one $AlCl_3$ pulse and a water pulse, or alternatively, of a single $Sm(thd)_3$ pulse and a water pulse. Said $Al_2O_3$:Sm intermediate layers are deposited so that the processing of each intermediate layer will include one $SmO_x$ cycle which is grown as the last layer of each intermediate layer, above a preceding $Al_2O_3$ layer. The individual zinc sulfide layers 11 in all samples are comprised of 200 ALE cycles, whereby their thickness becomes approx. 250 Å. The thickness of the $Al_2O_3$:Sm intermediate layer varies in the different samples. Five sample structures are grown having their intermediate layers comprised of 0/0, 1/1, 3/1, 10/1 and 100/1 ($Al_2O_3/SmO_x$) ALE cycles in which the growth rate is approx. 0.5 Å/cycles. Thus, the first sample is equivalent to pure zinc sulfide. The integer constant N has a value 30 in all samples.

Figure 5:
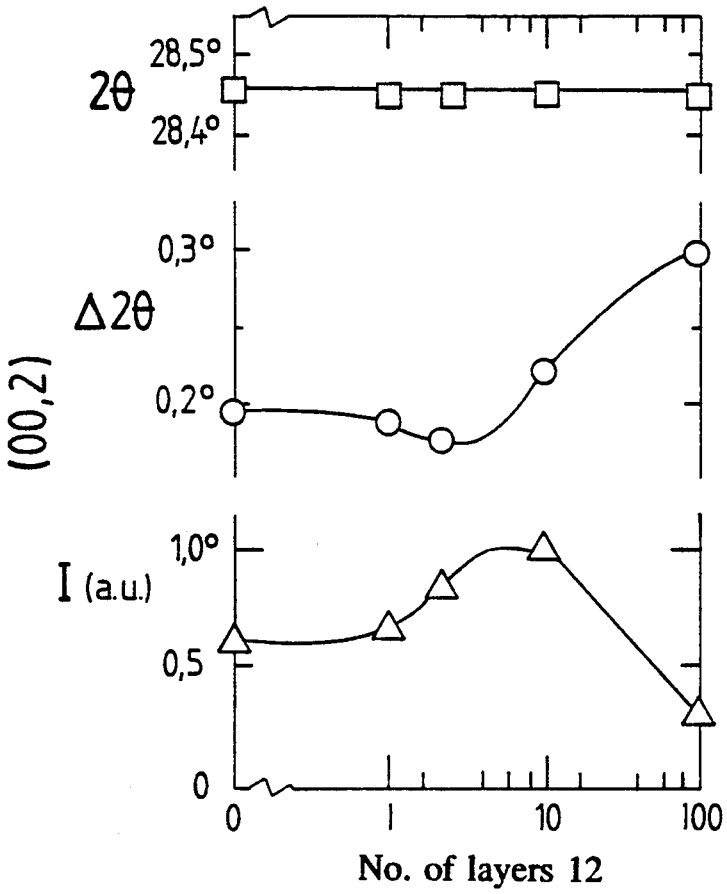
FIG. 5 shows a diagram of x-ray diffraction measurement results for a layer structure described in Example 1.

Measurements of x-ray diffractograms taken on the produced thin-film structures give the results described below. Peaks in the x-ray diffractograms of all five samples can be indexed according the wurtzite structure of zinc sulfide, and the orientation in structures is strongly directed in the (00.2) direction. The substrate or intermediate layers do not cause extraneous peaks in the x-ray diffractogram. As is evident from FIG. 5, the position of the peak ($2\Theta$=approx. 28.5°) representing the (00.2) reflection stays essentially constant. The half-value width $\Delta 2\Theta$ of the peak stays initially almost constant (at approx. 0.19°) and even narrows, until it starts to widen with a further increasing layer thickness. The intensity of the peak (as defined from its area or height) first grows and then decreases, finally dropping off drastically.

Thus, the layer structure is proven to maintain the hexagonal crystal structure and orientation of zinc sulfide despite the thin intermediate $Al_2O_3$:Sm layers. Only very thick intermediate layers (in excess of 10 ALE cycles) are capable of distorting the crystal structure. An unusual phenomenon is found therein that thin intermediate layer can even improve the crystal order of the zinc sulfide layer structure and strengthen its crystal orientation.

EXAMPLE 2

Effect of activator doping on the electroluminescent characteristics of the phosphor layer.

First, electroluminescent structures shown in FIG. 1 are fabricated. Glass is used as the transparent substrate 1, on which is deposited a transparent, sputtered bottom electrode 2 of indium-tin oxide having a thickness of 300 nm and a dielectric thin-film layer 3 of 300 nm thick aluminium-titanium oxide fabricated using the Atomic Layer Epitaxy deposition method. The phosphor layer 4 is grown into a layered structure shown in FIG. 2 using the Atomic Layer Epitaxy deposition method. The basic structure of obtained samples of the phosphor layer 4 is Nx((layer 7)+(layer 8))+(layer 7), where N is an integer multiplier, the host matrix material layer, layer 7, is zinc sulfide and the activator-containing doping layer, layer 8, is terbium sulfide. The substrate is held at 500° C. during the process, and the inert atmosphere pressure is 1 mbar. The zinc sulfide layers are deposited as in Example 1, whereby the film growth rate is 1.25 Å per ALE cycle and the terbium sulfide layers are grown using $Tb(thd)_3$ chelate and hydrogen sulfide as initial reactants, whereby each ALE cycle is comprised of one pulse of each reactant and the achieved growth rate is approx. 0.1 Å per ALE cycle. On the phosphor layer is fabricated a dielectric, thin-film insulating layer 5 of 300 nm thick aluminium-titanium oxide by means of the Atomic Layer Epitaxy deposition method. Finally, a metallic upper electrode thin-film layer 6 of 1000 nm thick aluminium is fabricated by evaporative deposition. Production methods and characteristics of other thin-film structures in the samples except those of the phosphor layers are not essential for the explanation of the example.

Three sample structures are grown having their zinc sulfide layers 7 comprised of a) 10, b) 50, and c) 200 ALE cycles. Correspondingly, the terbium sulfide layers 8 are comprised of a) 1, b) 5, and c) 20 ALE cycles. Thus, the mutual quantity ratio between zinc and terbium remains constant in the samples. In order to maintain a constant thickness of the samples, the integer constant N is varied so as to be a) 600, b) 120, and c) 30 for the samples, respectively.

Measurements of x-ray diffractograms taken on the produced thin-film structures give the results described below. All samples yield a notable finding that the terbium sulfide layer does not entirely inhibit the growth of the zinc sulfide crystal lattice. However, a dense placement of activator-containing doping layers without matching layers disturbs the crystalline perfection. With an increase in the thickness of the zinc sulfide layer, the crystalline perfection is improved ($\Delta 2\Theta$ becomes smaller) and the degree of orientation is improved (the relative intensity of the peak at the (00.2) direction increases). The terbium concentration was detected to be identical at approx. 1 mol. % (Tb/zn) in all samples as determined by x-ray fluorescence methods.

Figure 6:
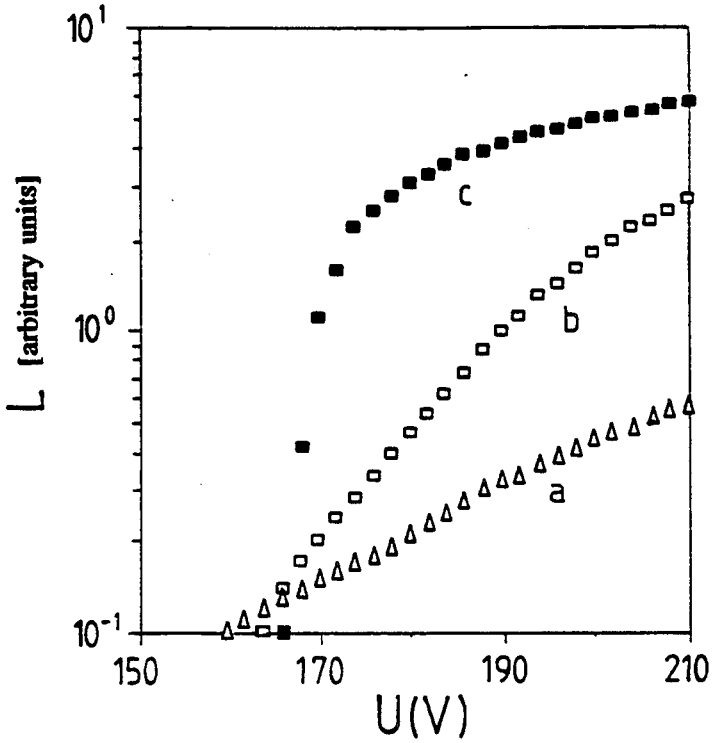
FIG. 6 shows a diagram of the brightness as a function of excitation voltage for an electroluminescent structure described in Example 2.

With a growth in the thickness of the zinc sulfide layer, a significant change in the dependence of brightness on the excitation voltage is noted as is evident from FIG. 6. A thicker zinc sulfide layer leads to a stronger dependence of the brightness on the excitation voltage. This can be attributed to the higher efficiency in the electron acceleration and transfer with results from the improved crystallinity in the phosphor layer. Hence, the exploitation possibilities of using the above-described structures in electroluminescent display components are vastly expanded.

EXAMPLE 3

Fabrication of a bright green-light emitting electroluminescent display component by means of layered activator doping according to the invention.

First, electroluminescent structures shown in FIG. 1 are fabricated. With the exception of the phosphor layer 4, the substrate and thin-film materials as well as their thicknesses and characteristics are identical to those employed in Example 2. Using the Atomic Layer Epitaxy method, the phosphor layer 4 is grown according to the principles shown in FIGS. 2 and 3 into a layered structure with alternating order of the host matrix material layers 7, the actual activator layers 10 and the matching layers 9. Thus, the basic structure of obtained phosphor layer 4 is Nx((layer 7(+(layer 9)+(layer 10)+(layer 9))+(layer 7), where the host matrix material layer, layer 7, is zinc sulfide, the activator-containing doping layer, layer 10, is terbium sulfide, and the matching layer, layer 9, is zinc aluminium oxide. The substrate is held at 500° C. during the process, and the inert atmosphere pressure is 1 mbar. The zinc sulfide layers are deposited in the same fashion as in Example 1 and the terbium sulfide layers in the same fashion as in Example 2. The zinc aluminium oxide layers are grown using zinc chloride, aluminium chloride and water as initial reactants, whereby one ALE cycle is comprised of subsequent pulses of $AlCl_3$, $H_2O$, $ZnCl_2$, $H_2O$, $AlCl_3$ and $H_2O$. The achieved growth rate is approx. 1.5 Å per ALE cycle. Production methods and characteristics of other thin-film structures in the samples except those of the phosphor layer are not essential for the explanation of the Example.

Three sample structures are grown having their zinc sulfide layers 7 comprised of a) 100, b) 200, and c) 300 ALE cycles. The activator-containing doping layers 8 are produced identically for all samples. The activator-containing doping layers 8 are comprised of 30 ALE cycles of terbium sulfide, and the matching layers 9 comprise a single ALE cycle of zinc aluminium oxide. In order to maintain a constant thickness of the samples, the integer constant N is varied so as t be a) 60, b) 30, and c) 20 for the samples, respectively.

Figure 7:
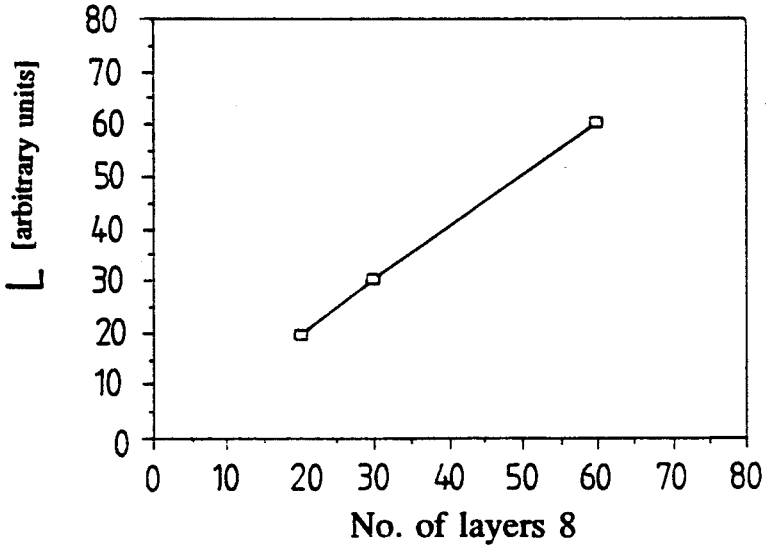
FIG. 7 shows the dependence of brightness on the number of activator-containing doping layers.

Measurements of x-ray diffractograms taken on the produced thin-film structures give the results described below. All three samples have at least as good crystallinity as that of pure zinc sulfide. Hence, the activator-containing doping layer does not terminate the growth of the zinc sulfide crystal lattice. Brightness vs. excitation voltage measurements proved the advantageous electroluminescent characteristics of the structure, namely, a strong dependence of brightness to the excitation voltage as well as a high efficiency of light emission. These result in high total brightness of the electroluminescent structure and stability of emission. The brightness measurements at 35 V above the threshold voltage are shown in FIG. 7. The total brightness is linearly proportional to the number of activator-containing doping layers in the phosphor layer system. The layered activator doping method according to the invention achieves a significant improvement in the intensity and stability of emission over homogeneously doped phosphor layer systems.

EXAMPLE 4

Fabrication of a bright red-light emitting electroluminescent display component by means of layered activator doping according to the invention.

First, electroluminescent structures shown in FIG. 1 are fabricated. With the exception of the phosphor layer 4, the substrate and thin-film materials as well as their thicknesses and characteristics are identical to the those employed in Example 2. Using the Atomic Layer Epitaxy method, the phosphor layer 4 is grown according to the principles shown in FIGS. 2 and 3 into a layered structure with alternating order of the host matrix material layers 7, the actual activator layers 10 and the matching layers 9. Thus, the basic structure of obtained phosphor layer 4 is Nx((layer 7)+(layer 9)+(layer 10)+(layer 9))+(layer 7), where the host matrix material layer, layer 7, is zinc sulfide, the actual activator layer, layer 10, is yttrium oxide doped with europium, and the matching layer, layer 9, is zinc sulfide doped with calcium. The substrate is held at 500° C. during the process, and the inert atmosphere pressure is 1 mbar. The zinc sulfide layers are deposited as in Example 1. The actual activator layers are grown using $Y(thd)_3$ and $Eu(thd)_3$ chelates and water as initial reactants, whereby one ALE cycle is comprised of subsequent pulses of $Y(thd)_3$, $H_2O$, $Eu(thd)_3$, $H_2O$, $Y(thd)_3$ and $H_2O$. The achieved growth rate is approx. 0.3 Å per ALE cycle. In the matching layer 9, each ALE cycle comprises a set of subsequent pulses of $Ca(thd)_2$, $H_2S$, $ZnCl_2$ and $H_2S$. The growth rate is approx. 1 Å per ALE cycle. Production methods and characteristics of other thin-film structures in the samples except those of the phosphor layer are not essential for the explanation of the example.

Three sample structures are grown having their actual activator layers comprised of a) 10, b) 20, and c) 30 ALE cycles of yttrium oxide doped with europium. The zinc sulfide layers 7 are produced identically for all samples to contain 200 ALE cycles. The matching layers 9 comprise five ALE cycles of a compound having a portion of the zinc in the zinc sulfide substituted with calcium.

Figure 8:
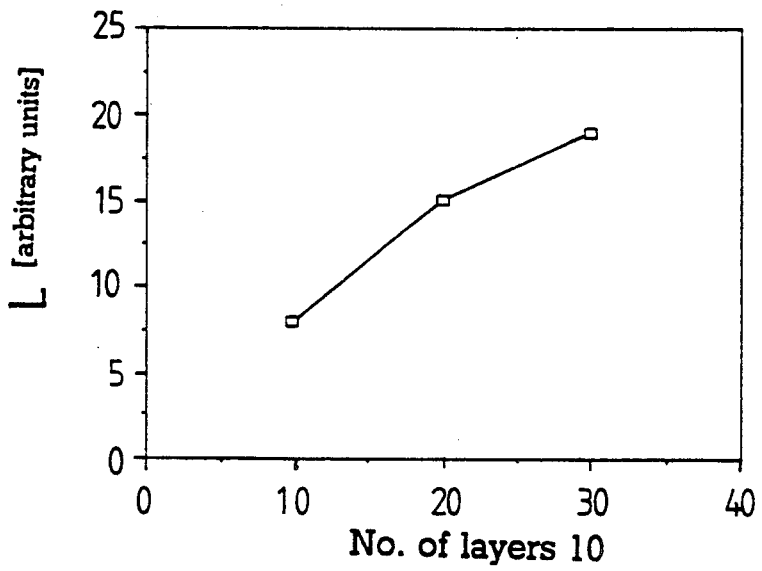
FIG. 8 shows the dependence of brightness on the thickness of activator-containing doping layers.

When the x-ray diffractograms of the thin-film structures are measured, it is evident that the activator-containing doping layer does not terminate the growth or orientation of the zinc sulfide crystal lattice. The red-light emission from the electroluminescent structure increases with thicker activator-containing doping layers as shown in FIG. 8.

While the phosphor layer system 4 characteristic of the invention is in the above description solely employed in conjunction with the conductor-insulator-phosphor-insulator-conductor structure shown in FIG. 1, the use of a phosphor layer according to the basic idea of the invention is not limited therein, but rather it can also be utilized in other types of electroluminescent components. The proposed selection of materials must not be understood to exclude the use of other conceivable kinds of host matrix/activator material systems from the application range of the invention.

What is claimed is:

1. A phosphor layer of an electroluminescent component, the layer being comprised of superimposed host matrix material layers to accelerate electrons and activator-containing doping layers capable of producing light emission alternately placed between the host matrix layers, the phosphor layer comprising at least two of said host matrix material layers and at least one activator-containing doping layer, the at least one activator-containing doping layer including a matching layer having a thickness less than 10 nm, such that the at least one activator-containing doping layer matches epitaxially on the host matrix layers while essentially avoiding disturbance of the crystal structure growth of the host matrix material layers that accelerate electrons.

2. A phosphor layer as defined in claim 1 wherein said at least one activator-containing doping layer includes at least one activator layer.

3. A phosphor layer as defined in claim 2 wherein the thickness of the activator layer is in the range of 0.5 to 5 nm.

4. A phosphor layer as defined in claim 1 wherein said activator-containing doping layer comprises at least the matching layer and at least one activator layer in superimposed relationship.

5. A phosphor layer as defined in claim 4 wherein the thickness of said matching layer is in the range of 0.5 to 5 nm.

6. A phosphor layer as defined in claim 4 wherein the matching layer is of a metal sulfide such as aluminum sulfide ($Al_2S_3$), calcium sulfide (CaS) or zinc aluminum spinel ($ZnAl_2S_4$).

7. A phosphor layer as defined in claim 4 wherein said matching layer is mixed material comprised of a partial layer of the host matrix material and a substituent whereby said partial layer of host matrix material and the substituent are, for example, zinc sulfide and calcium ($Zn_{1-x}Ca_xS$), zinc sulfide and cadmium ($Zn_{1-x}Cd_xS$) or zinc sulfide and silinium ($ZnS_{1-x}Se_x$).

8. A phosphor layer as defined in claim 4 in which the layers of host matrix material and activator-containing doping layers with superimposed at least one matching layer and at least one activator layer are deposited in atomic layers as can be obtained using the Atomic Layer Epitaxy or Molecular Beam Epitaxy methods.

9. A phosphor layer as defined in claim 1 further comprising at least two different kinds of the activator.

10. A phosphor layer as defined in claim 1 further including at least two said activator-containing doping layers containing different kinds of the activator.

11. A phosphor layer as defined in claim 1 wherein the host matrix material layer is a II–VI compound such as zinc sulfide (ZnS), zinc selenide (ZnSe), cadmium sulfide (CdS) or an alkali earth metal chalcogenide such as calcium sulfide (CaS) and strontium sulfide (SrS) or a mixed compound thereof such as $ZnS_{1-x}Se_x$ or $CA_{1-x}Sr_xS$.

12. A phosphor layer as defined in claim 1 wherein each of the host matrix material layers is strontium sulfide doped with cerium (SrS:Ce), zinc sulfide doped with manganese (ZnS:Mn) or calcium sulfide doped with europium (CaS:Eu).

13. A phosphor layer as defined in claim 1 wherein said activator-containing doping layer contains manganese (Mn) or rare earths such as cerium (Ce), samarium (Sm), europium (Eu), praseodymium (Pr), terbium (Tb) or thulium (Tm) as the activator.

14. A phosphor layer as defined in claim 13 wherein the activator layer is a II–IV compound such as ZnS, ZnSe or CdS, or an alkali earth metal chalcogenide such as MgS, CaO, CaS, SrS or BaS, doped with said activator.

15. A phosphor layer as defined in claim 13 wherein said activator layer is essentially of a rare-earth oxide $Ln_2O_3$ in which Ln can be, for example, Sc, Y or Gd, a rare-earth sulfide $Ln_2S_3$ in which Ln is, for example, Y or La or a rare-earth oxysulfide $Ln_2O_2S$ in which Ln is, for example, Y, La or Gd, doped with said activator.

16. A phosphor layer as defined in claim 13 wherein the activator layer is essentially of an aluminate $(M,Ln)AlO_x$ or gallate $(M,Ln)GaO_x$ in which M is, for example, Zn, Ca, Sr or Ba and Ln is Y, La, Gd or Ce, doped with said activator.

17. A phosphor layer as defined in claim 13 wherein said activator layer is essentially of a halide $MX_2$ or $LnX_3$ or an oxyhalide LnOX, in which M is, for example, Ca, Sr or Ba; Ln is Y, La, Gd or Ce; and X is F, Cl or Br, doped with said activator.

* * * * *